US007342207B2

(12) United States Patent
Hasse et al.

(10) Patent No.: US 7,342,207 B2
(45) Date of Patent: Mar. 11, 2008

(54) ELEVATED MICROWAVEABLE CARTON AND SUSCEPTOR PORTION AND METHODS

(75) Inventors: Joey Hasse, Marshall, MN (US); David Rettey, Tracy, MN (US); James A. McGillivray, Marshall, MN (US)

(73) Assignee: Schwan's Sales Enterprises, Inc., Marshall, MN (US)

( * ) Notice: Subject to any disclaimer, the term of this patent is extended or adjusted under 35 U.S.C. 154(b) by 0 days.

(21) Appl. No.: 11/671,871

(22) Filed: Feb. 6, 2007

(65) Prior Publication Data

US 2007/0125773 A1 Jun. 7, 2007

Related U.S. Application Data

(62) Division of application No. 11/143,226, filed on Jun. 2, 2005, now Pat. No. 7,196,299.

(51) Int. Cl.
*H05B 6/80* (2006.01)

(52) U.S. Cl. ..... 219/730; 219/725

(58) Field of Classification Search ..... 219/730, 219/634, 759, 725, 771, 678; *H05B 6/80*
See application file for complete search history.

(56) References Cited

U.S. PATENT DOCUMENTS 3,876,131 A 4/1975 Tolaas
4,260,060 A 4/1981 Faller
4,798,323 A 1/1989 Platt
4,960,598 A 10/1990 Swiontek
4,999,466 A 3/1991 Waligorski
5,118,033 A 6/1992 Kula
5,124,519 A * 6/1992 Roy et al. ..... 219/759
5,153,402 A 10/1992 Quick et al.
5,294,765 A * 3/1994 Archibald et al. ..... 219/727
5,519,195 A 5/1996 Keefer et al.
5,530,231 A * 6/1996 Walters et al. ..... 219/730

(Continued)

FOREIGN PATENT DOCUMENTS

EP 0 503 302 A2 9/1992

(Continued)

*Primary Examiner*—Daniel Robinson
(74) *Attorney, Agent, or Firm*—Merchant & Gould P.C.

(57) ABSTRACT

A carton for use in microwave ovens includes a base and a removable cover. The base has a cooking surface at least partially covered with a microwave susceptor material. The base defines an aperture arrangement. In preferred embodiments, the carton is triangular-shaped with an apex region. The apex region does not have a susceptor material, and can include a microwave shield. The removable cover can function as a cover, a platform, and a tray. A packaged food product includes a food product, such as a slice of pizza, oriented within the carton. Methods of packaging and use are provided.

7 Claims, 2 Drawing Sheets

U.S. PATENT DOCUMENTS

| | | | | |
|---|---|---|---|---|
| 5,788,145 | A | 8/1998 | Grahahm et al. | |
| 5,986,248 | A | 11/1999 | Matsuno et al. | |
| 6,230,917 | B1 | 5/2001 | Whitnell | |
| 6,299,059 | B1 | 10/2001 | Bernstein | |
| 6,386,498 | B1 | 5/2002 | Deco | |
| 6,414,290 | B1 * | 7/2002 | Cole et al. | 219/759 |
| 6,670,592 | B2 | 12/2003 | McCarthy et al. | |
| 6,695,202 | B2 | 2/2004 | Miess | |
| 6,700,106 | B2 | 3/2004 | Cochran et al. | |
| 6,765,182 | B2 | 7/2004 | Cole et al. | |
| 7,196,299 | B2 * | 3/2007 | Hasse et al. | 219/730 |
| 2003/0206997 | A1 | 11/2003 | Winkelman et al. | |

FOREIGN PATENT DOCUMENTS

| | | | |
|---|---|---|---|
| EP | 1 479 619 | A2 | 11/2004 |
| JP | 2005082197 | | 3/2005 |
| WO | 99/20116 | | 4/1999 |

* cited by examiner

FIG. 1
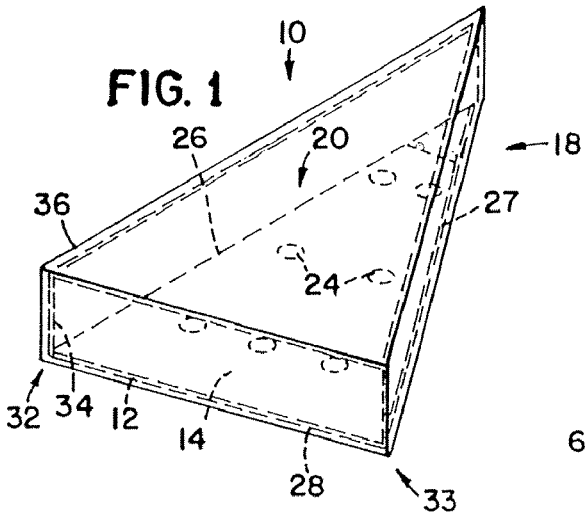
FIG. 3
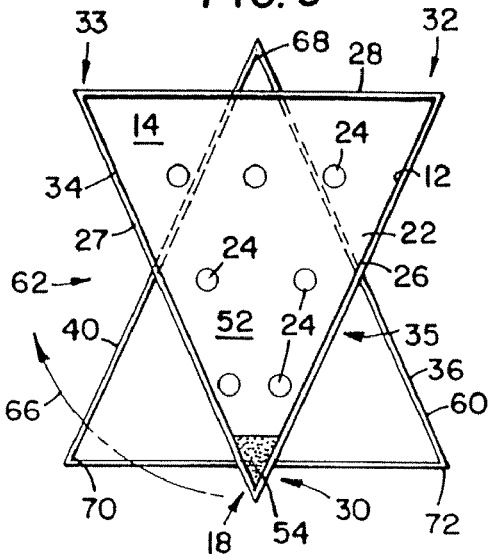
FIG. 2
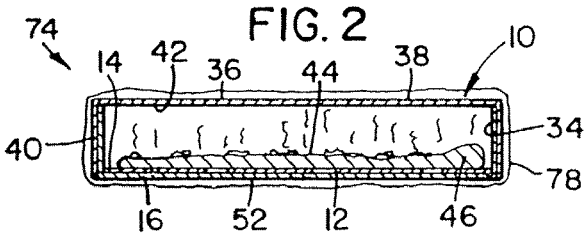
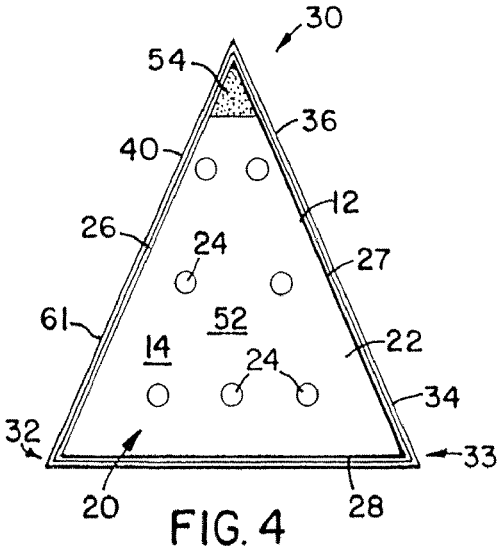
FIG. 4
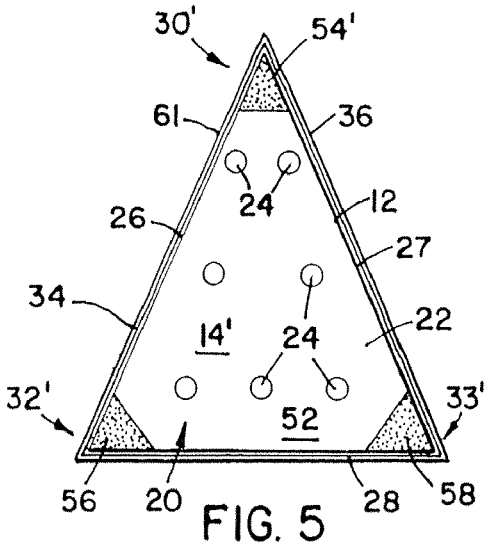
FIG. 5

ELEVATED MICROWAVEABLE CARTON AND SUSCEPTOR PORTION AND METHODS

This application is a divisional of U.S. patent application Ser. No. 11/143,226, filed Jun. 2, 2005 now U.S. Pat. No. 7,196,299 application Ser. No. 11/143,226 is incorporated herein as reference.

TECHNICAL FIELD

This disclosure relates to cartons for heating food products in a microwave oven. This disclosure also relates to a packaged food product and methods of use.

BACKGROUND

Cartons for cooking food in a microwave oven are known. Such cartons can include a microwave susceptor, which has the property of increasing its own temperature by partially absorbing energy of the microwave and then transmitting thermal energy to the food. This helps to provide browned or crispened areas in the region to the susceptor material.

A variety of container configurations are provided in the prior art. Improvements, however, are desirable.

SUMMARY

This disclosure is directed to a carton for use in microwave ovens. To achieve the advantages and in accordance with the purposes as embodied and broadly described herein, a carton is provided having a substantially triangular-shaped base, the base having a cooking surface and an opposite surface. The base defines an aperture arrangement extending therethrough from the cooking surface to the opposite surface and a non-apertured region. The cooking surface is defined as the non-apertured region. The carton further includes a microwave susceptor material on the cooking surface of the base. The susceptor material covers at least 50% and not greater than 99% of the cooking surface of the base.

In one arrangement, the microwave susceptor material covers at least 70% and not greater than 95% of the cooking surface of the base.

In preferred arrangements, the substantially triangular-shaped base defines at least one apex region. The at least one apex region is substantially free of susceptor material.

In certain embodiments, the cooking surface of the at least one apex region is covered with a microwave shield.

In certain preferred arrangements, the carton further includes a substantially triangular-shaped three-sided pizza product oriented on the cooking surface. The pizza product has an edge crust along one of the sides and a tip vicinity opposite of the edge crust. The pizza product tip vicinity is oriented on the cooking surface of the apex region. In certain preferred embodiments, the cooking surface of the apex region is covered with a microwave shield.

Preferably, there is a cover selectively removable from the triangular base. The cover includes a planar region and a side arrangement extending generally orthogonal to the planar region. In some embodiments, the planar region of the cover has a same shape as the substantially triangular base. In certain embodiments, a surrounding wall extends generally orthogonal to the substantially triangular base.

In another aspect, a packaged food product is provided. The packaged food product includes a substantially triangular-shaped container defining an interior volume. The container includes a body and a removable cover. The body defines an aperture arrangement, and at least a portion of the body has a microwave susceptor material thereon. A food product is oriented in the interior volume. A removable outer wrapping encloses the container with the food product. The cover is oriented over the body and is completely selectively removable from the body to result in no physical connection therebetween, when the outer wrapping has been removed.

Preferably, the body comprises a substantially triangular base having a cooking surface and a surrounding wall extending generally orthogonal to the base, and the cover comprises a substantially triangular planar region and a side arrangement extending generally orthogonal to the planar region.

In some arrangements, the microwave susceptor material covers at least 50% and not greater than 99% of the cooking surface.

Preferably, the base defines the aperture arrangement.

In some embodiments, the base includes an apex region, and a microwave shield is oriented on the cooking surface of the apex region.

In another aspect, a stacked arrangement is provided. The stacked arrangement includes a first member of dielectric material including a substantially triangular planar region and a side arrangement extending generally orthogonal to the planar region. The substantially triangular planar region comprises first, second, and third corner regions. A second member of dielectric material is removably stacked on the first member. The second member includes a substantially triangular base having a cooking surface. The substantially triangular base comprises first, second, and third base corner areas. The substantially triangular base is supported by the side arrangement. The substantially triangular base is oriented relative to the substantially triangular planar region to result in the first base corner area being located between the second corner region and the third corner region, and the first corner region being located between the second base corner area and the third base corner area.

In some embodiments, the cooking surface is at least partially covered with a microwave susceptor material.

In some arrangements, the cooking surface includes an apex region, which includes the first base corner area. The apex region is preferably free of microwave susceptor material.

Preferably, the substantially triangular base defines an aperture arrangement therethrough. The second member further includes a surrounding wall extending generally orthogonal to the substantially triangular base.

In preferred arrangements, the stacked arrangement further includes a food product oriented on the cooking surface.

In another aspect, a method of preparing food is provided. The method includes providing a food product on a substantially triangular-shaped base. The base defines an aperture arrangement. A susceptor material at least partially covers the base. The method further includes positioning the base on a side arrangement of a cover member. The cover member includes a substantially triangular-shaped planar member having the side arrangement extending from the planar member.

Preferably, the step of positioning includes positioning a first base corner area of the triangular-shaped base to be between a second and a third corner region of the substantially triangular-shaped planar member, and positioning the first corner region to be between a second and third base corner area of the substantially triangular-shaped base.

Preferably, the method includes after the step of positioning, heating the food product and then positioning the substantially triangular-shaped base with the food product thereon to rest within the cover member by orienting the first base corner area over the first corner region.

Preferably, the step of heating the food includes applying microwave energy to the food product.

In one embodiment, the method includes before the step of providing a food product on a substantially triangular-shaped base, removing the cover member from a position covering the substantially triangular-shaped base. In some arrangements, before the step of removing the cover member, there is a step of removing an outer wrapper enclosing the food product, the base, and the cover member.

Preferably, the step of providing a food product includes providing a triangular-shaped pizza product. The pizza product has an edge crust along one side and a tip opposite of the edge crust. The method includes orienting the pizza product on the base so that the pizza product tip is on an area of the base not covered with susceptor material.

In another aspect, a carton is provided. The carton includes a base having a cooking surface and an opposite surface. The base has a shape defining at least one corner area. The base defines an aperture arrangement extending therethrough from the cooking surface to the opposite surface. A microwave susceptor material is on the cooking surface of the base. The at least one corner area is free of microwave susceptor material, and in some arrangements, is covered with a microwave shield material.

In some arrangement, the carton further includes a surrounding wall extending generally orthogonal to the base.

Preferably, the carton further includes a cover selectively removable from the base. The cover includes a planar region and a side arrangement extending generally orthogonal to the planar region. In some embodiments, the planar region of the cover has a same shape as the base.

Preferably, the side arrangement of the cover overlaps the surrounding wall, and the planar region is generally parallel to the base to define an interior volume therein, when the cover is operably mounted over the base.

In preferred embodiments, the carton further includes a food product oriented in the interior volume.

BRIEF DESCRIPTION OF THE DRAWINGS

FIG. 1 is a perspective view of an embodiment of a carton including a base and removable cover constructed according to principles of this disclosure;

FIG. 2 is a cross-sectional view of an embodiment of a packaged food product including the carton of FIG. 1 containing a food product and having an outer wrapper;

FIG. 3 is a top plan view of the carton of FIG. 1, and showing the base oriented on top of the removable cover;

FIG. 4 is a top plan view of the carton of FIGS. 1 and 3 and showing the base mounted within the cover;

FIG. 5 is a top plan view of an alternate embodiment of a carton, with the base mounted within the cover.

DETAILED DESCRIPTION

A. Some Problems with Existing Arrangements

Figure 6:
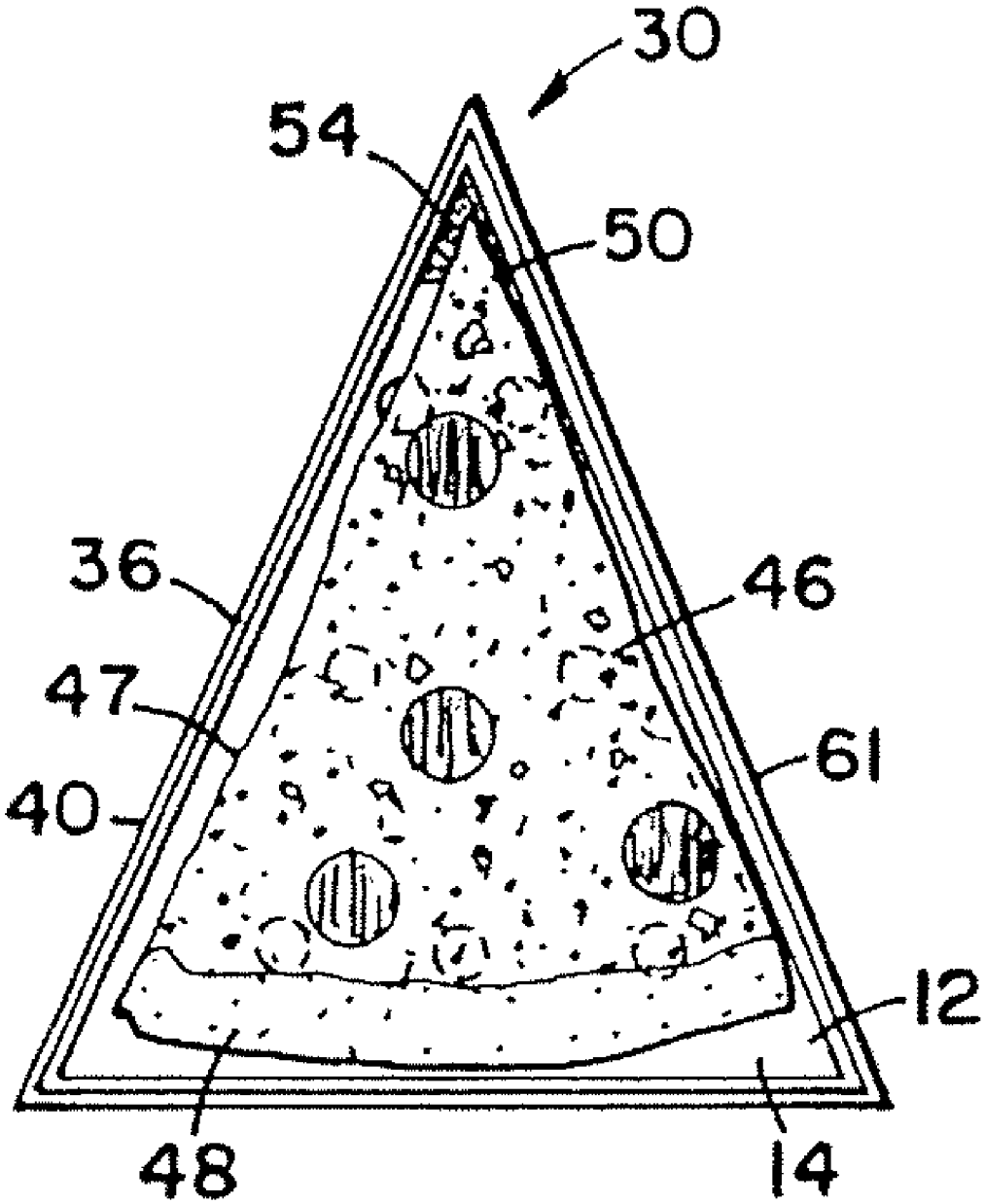
FIG. 6 is a top plan view of a pizza product oriented on the arrangement of FIG. 4.

There are existing products with microwave susceptor material to help brown or crispen the food product during microwaving. In some cases, the food product can become tough and overcooked. For example, if cooking a triangular slice of pizza, the end tip of the pizza can become overcooked compared to the rest of the pizza, if the end tip is exposed to susceptor material. This disclosure addresses this problem, among other shortcomings in the prior art.

In one preferred embodiment, this disclosure describes a two-piece paperboard carton that contains a susceptor, microwave shielding, and vent holes. Certain preferred embodiments have the paperboard as being triangular-shaped. The carton can hold a single slice of pizza. To use, a removable cover is placed under the carton base to raise the pizza a distance off of the microwave floor, which allows the pizza to get increase microwave penetration than if the pizza were resting against the microwave floor. In addition, raising the pizza a distance off of the microwave floor allows moisture to escape from the crust out of vent holes in the carton base, which aids in crisping. Also, in preferred embodiments, there is a microwave shield at the tip of the carton that is used to shield the tip of the pizza from microwaves. This prevents the tip from getting tough and overcooked. After the pizza is done cooking, the base member containing the pizza can be placed in the cover member to cover the vent holes and prevent any grease from dripping from the holes onto the consumer.

B. FIGS. 1-6

In reference to FIG. 1, a container or carton is shown generally at 10. The container or carton 10 is preferably made of a material that can be exposed to microwave energy without damage. For example, the carton 10 can be made from a dielectric material, a paperboard material, plastic, or composites thereof.

In general, the carton 10 includes a base 12 having a cooking surface 14 and an opposite surface 16 (FIG. 2). The base 12 has a shape that defines at least one corner region 18. A variety of shapes are contemplated. Such shapes can include rectangular, square, polygonal, irregular, or triangular. In the particular embodiment illustrated in the FIGS., the base 12 is substantially triangular-shaped. By the term "substantially triangular-shaped", it is meant that the base 12 has, in general, no more than three sides, but does not need to be an exact geometric definition of a triangle. For example, the substantially triangular-shaped base 12 can include somewhat rounded corners and curved sides. In addition, the substantially triangular-shaped base 12 can include more than three sides, provided the overall general impression is triangular.

In preferred embodiments, the base 12 defines an aperture arrangement 20 extending therethrough from the cooking surface 14 to the opposite surface 16. The region of the base 12 that does not have apertures is a non-apertured region 22. The cooking surface 14 is defined as the non-apertured region 22. The aperture arrangement 20 allows for moisture to escape from the food product being cooked in the microwave out of the aperture arrangement 20. It will also allow for the draining of moisture and grease from the food product after the food has been prepared. In the embodiment shown, the aperture arrangement 20 includes a plurality of spaced apertures or holes 24. In the embodiment shown, there are seven holes. Of course, more or fewer holes 24 can be used. The holes 24 are depicted as circular, and can be many different shapes including slits, slots, punches, rectangular, triangular, polygonal, and irregular shaped. The aperture arrangement 20 has, in example embodiments, an overall area of at least 1% and not greater than 50% of the overall area of the base 12.

The base 12 depicted in the FIGS. is shown as having first, second, and third edges 26, 27, 28. Again, the particular embodiment shows the edges 26, 27, 28 as being straight, but the edges can be non-linear, curved, or irregular shaped.

The base 12 defines an apex region 30 on the cooking surface 14. The apex region 30 is between the first edge 26 and second edge 27. In general, the apex region 30 covers an area of the cooking surface 14 at least 1 square inches, and not greater than 44 square inches, typically 2-10 square inches. In the particular embodiment shown, the apex region 30 is triangular in shape. In example arrangements, apex region 30 covers an area of the cooking surface 14 at least 1% and not greater than 50% of the cooking surface 14, for example, at least 5% and not greater than 40% of the cooking surface 14.

As mentioned above, the base 12 defines at least one corner area 18. In the particular arrangement shown, the base 12 defines first, second, and third base corner areas 18, 32, and 33. By the term "corner area", it is meant generally the intersection of two of the edges 26, 27, 28. However, it should be understood that the corner areas 18, 32, and 33 need not be perfect, geometric corners. Rather, the corner areas can be rounded or have extra edges and curves, provided the overall impression left to a person viewing it is generally a corner. In the embodiment illustrated, the apex region 30 includes the first base corner area 18.

The carton 10 further includes a surrounding wall 34 extending generally orthogonal to the base 12. In particular, the surrounding wall 34, in the illustrated embodiment, is an integral, single-piece part of the base 12. The surrounding wall 34, as illustrated, completely surrounds or circumscribes the cooking surface 14, such that there are no gaps, holes, or other discontinuations in the wall 34. In other embodiments, the surrounding wall 34 can include gaps, breaks, discontinuations including apertures as part of the aperture arrangement 20 to help vent the carton 10. The base 12, in combination with the wall 34, forms a body 35 (FIG. 3).

In accordance with principles of this disclosure, the carton 10 further includes a cover selectively removable from the base 12. As embodied herein, the carton 10 includes a cover 36 that is completely and selectively removable from the base 12. By the term "completely and selectively removable", it is meant that, in preferred embodiments, the cover 36 is not connected to the base 12 through any folds, flanges, hinges, or other connections. Instead, the cover 36 can be removed to be completely separated from the base 12.

In the embodiment shown, the cover 36 includes a planar region 38 (FIG. 2) and a side arrangement 40 extending generally orthogonal to the planar region 38. In the embodiment shown, the side arrangement 40 surrounds or circumscribes the planar region 38. In preferred arrangements, the side arrangement 40 will overlap an exterior of the surrounding wall 34 of the base 12. As such, it should be understand that in preferred embodiments, an outermost inner dimension between sides of the side arrangement 40 is greater than an outermost inner dimension between sides in the surrounding wall 34. As can be seen in FIG. 2, the planar region 38 is generally parallel to the base 12, when the cover 36 is mounted on the base 12. This defines an interior volume 42 therewithin, when the cover 36 is operably mounted over the base 12. The interior volume 42 is useable to hold a food product 44 therewithin. In the example embodiment illustrated, the food product 44 comprises pizza 46.

In preferred embodiments, the cover 36 has a same shape as the base 12. In the embodiment shown, the cover 36 is substantially triangular. Preferably, the cover 36 is sized to: (i) function as a cover, as shown in FIG. 1; (ii) function as a platform 60, as shown in FIG. 3; and (iii) function as a tray 61 or holder, as shown in FIG. 4. Specifically, in FIG. 1, it can be seen how the cover 36 operates to close the interior volume 42 and function as a lid or cover. In FIG. 3, the cover 36 is functioning as platform 60. In particular, when the food product 44 is going to be microwaved, the cover 36 is removed from the base 12, rotated in a direction opposite to the direction of orientation of the base 12, and the entire stacked arrangement 62 is exposed to microwave energy in a microwave oven. By functioning as platform 60, the cover 36 raises the food product 44 from a bottom surface of the microwave oven. This allows greater microwave energy penetration through the food product 44. This is described further below with respect to methods of use. FIG. 4 illustrates the cover 36 being used as a tray 64. After the food product 44 is microwaved, for example using the orientation of FIG. 3, the base 12 holding the food product 44 is moved in the direction of arrow 66 so that the base 12 holding the food product 44 matches the orientation of the cover 36 and slides within the cover 36. Specifically, the side arrangement 40 of the cover will be circumscribing the exterior of the surrounding wall 34 of the base 12. The cover 36 is located under the base 12 and can catch any grease, moisture, or any other material from the food product 44 draining through the aperture arrangement 20.

In the illustrated embodiment, the planar region 38 of the cover is substantially triangular-shaped. In the illustrated embodiment, the substantially triangular planar region 38 comprises a first corner region 68, a second corner region 70, and a third corner region 72. By the term "corner region", it is meant generally the intersection of two of the sides of the side arrangement 40. However, it should be understood that the corner regions 68, 70, 72 need not be perfect, geometric corners. Rather, the corner regions 68, 70, and 72 can be rounded or have extra edges or curves, provided the overall impression left to a person viewing it is generally a corner.

When forming the stacked arrangement 62 (FIG. 3), the substantially triangular base 12 is supported by the side arrangement 40 of the cover 36. The substantially triangular base 12 is oriented relative to the substantially triangular planar region 38 to result in the first base corner area 18 as being located between the second corner region 70 and the third corner region 72; and the first corner region 68 as being located between the second base corner area 32 and the third base corner area 33. Although not illustrated in FIG. 3, it should be understood that the base 12 will hold food product 44 thereon, such that the cover 36 functions as platform 60 to raise the food product 44 from a bottom portion of the microwave oven to allow for better penetration of microwave energy in the food product 44, than if the food product 44 were near or against the bottom surface of the microwave.

The pizza 46 can be in a variety of forms. In one contemplated embodiment shown in FIG. 6, the pizza 46 includes a triangular-shaped slice of pizza 47 having an edge crust 48 along one side and a tip 50 opposite of the edge crust 48.

In accordance with principles of this disclosure, the carton 10 includes a microwave susceptor material 52 to help to brown food product 44 oriented in the carton 10 when exposed to microwave energy. Such susceptor materials 52 are well known in the art, and examples are described in U.S. Pat. Nos. 4,833,007; 4,230,924; 4,267,420; and 5,107,089, each of which is incorporated herein by reference.

In preferred arrangements, the susceptor material 52 is oriented on the cooking surface 14 of the base 12. In many preferred embodiments, the susceptor material 52 is oriented only on the cooking surface 14 and not oriented on other portions of the carton 10. In certain preferred arrangements, the susceptor material 52 is selectively oriented to brown selected areas of the food product 44, particularly when the food product 44 is pizza 46. In general, it is contemplated that the susceptor material will cover at least 50% of the cooking surface 14. In many preferred arrangements, the susceptor material 52 will cover not more than 99% of the cooking surface 14 of the base 12. Preferably, the susceptor material 52 will cover at least 80% and not greater than 95% of the cooking surface 14 of the base 12. In some arrangements, the susceptor 52 covers at least 70%, while in other arrangements, it covers at least 50% of the cooking surface 14 of the base 12.

As mentioned above, the base 12 defines apex region 30. In preferred arrangements, the apex region 30 will be substantially free of susceptor material 52. By the term "substantially free", it is meant that at least 75% of the apex region 30 will be free of susceptor material 52, while it is preferred that 100% of the apex region 30 will be free of susceptor material 52. By leaving the apex region 33 free of susceptor material 52, the tip region 50 of the pizza 46 will not become tough and over-cooked.

In accordance with principles of this disclosure, the apex region 30 can be covered with a microwave shield. As embodied herein, a microwave shield is illustrated at 54. The shield 54 can include materials that block microwave energy from penetrating. Microwave shields are described in, for example, U.S. Pat. No. 6,696,677, incorporated herein by reference. With the shield 54 oriented on the apex region 30, the tip 50 of the pizza 46 will be protected from being over-cooked and/or tough.

An alternate embodiment is illustrated in FIG. 5. In FIG. 5, the cooking surface 14' is shown to have a shield at 56 and 58 on the second corner area 32' and the third corner area 33'. In the embodiment shown in FIG. 5 there is a shield 54' at apex region 30', along with shields 56 and 58 at the second corner area 32' and third corner area 33'. In this embodiment, each one of the apex region 30', second corner area 32', and third corner area 33' will shield or protect the food product 44 from being overcooked at areas of the food that overlap these portions 30', 32', and 33'. In alternate embodiments, instead of having shields 54', 56, and 58, there can be merely an absence of susceptor material 52.

In accordance with principles of this disclosure, a packaged food product is provided. As embodied herein, a packaged food product is illustrated in FIG. 2 at 74. The packaged food product 74 includes container or carton 10 defining interior volume 42. In the illustrated embodiment, the container 10 is substantially triangular-shaped. In other embodiments, it can be other shapes. In the embodiment shown, the container 10 includes body 35 (FIG. 3) and removable cover 36. The body 35 defines the aperture arrangement 20 therethrough. At least a portion of the body 35 includes the microwave susceptor material 52 oriented thereon. In particular, the microwave susceptor material 52 is oriented on the cooking surface 14 of the base 12. Food product 44, such as pizza 46, is oriented in the interior volume 42. The packaged food product 44 further includes a removable outer wrapping 78 enclosing the container 10 with the food product 44. The outer wrapping 78 is removable and disposable, to expose the container 10 containing the food product 44. After the outer wrapping 78 is removed, the cover 36 is selectively and completely removable from the body 35 to result in no physical connection between the body 35 and the cover 36.

After the outer wrapping 78 is removed, the cover 36 is removable from the body 35 and can be oriented below the body 35 to be platform 60 as shown in FIG. 3. In one arrangement, the cover 36 would be removed from the body 35, rotated 180° so that the first corner region 68 is located between the second base corner area 32 and the third base corner area 33, and then the stacked arrangement 62 is microwaved. In some embodiments, not only is the cover 36 rotated 180°, but it is also turned upside down so that the opposite surface 16 of the base 12 is resting against the side arrangement 40 of the cover 36. In other embodiments, the cover 36 is not flipped upside down, but is merely rotated 180° so that the opposite surface 16 of the base 12 is engaging against the planar region 38 of the cover 36.

Utilizing the structures and principles as described herein, a method of preparing food can be carried out. The method includes providing a food product, such as food product 44 including pizza 46 on a substantially triangular-shaped base, such as base 12. The base 12 defines aperture arrangement 20 and includes susceptor material 52 at least partially covering the base 12. The base is then positioned on a side arrangement of a cover member, such as side arrangement 40 of cover 36. The cover 36 includes the substantially triangular-shaped planar member or region 38 having the side arrangement 40 extending from the planar member or region 38.

After the step of positioning, the food product 44 is heated. After that, the substantially triangular-shaped base 12 with the food product 44 is positioned to rest within the cover 36 by orienting the first base corner area 18 over the first corner region 68 of the cover 36. The step of heating the food product 44 preferably includes applying microwave energy to the food product 44.

The step of providing food product 44 preferably includes providing triangular-shaped pizza product 47. The pizza product 47 would include an edge crust 48 along one side and tip 50 opposite of the edge crust 48. Next, the pizza product 47 would be oriented on the base 12 so that the pizza product tip 50 is on an area of the base not covered with the susceptor material 52. As shown herein, the tip 50 would be oriented on the apex region 30. In preferred embodiments, the apex region 30 further includes microwave shield 54.

The above description represents examples. Many embodiments can be made.

What is claimed is:

1. A stacked arrangement comprising:

(a) a first member of dielectric material including a substantially triangular planar region and a side arrangement extending generally orthogonal to the planar region;

(i) the substantially triangular planar region comprising first, second, and third corner regions;

(b) a second member of dielectric material removably stacked on the first member; the second member including a substantially triangular base having a cooking surface;

(i) the substantially triangular base comprising first, second, and third base corner areas;

(ii) the substantially triangular base being supported by the side arrangement;

(iii) the substantially triangular base being oriented relative to the substantially triangular planar region to result in:

(A) the first base corner area being located between the second corner region and the third corner region; and (B) the first corner region being located between the second base corner area and the third base corner area.

2. A stacked arrangement according to claim 1 wherein the cooking surface is at least partially covered with a microwave susceptor material.

3. A stacked arrangement according to claim 2 wherein:

(a) the cooking surface includes an apex region; the apex region including the first base corner area; and (b) the apex region is free of microwave susceptor material.

4. A stacked arrangement according to claim 3 wherein:

(a) the substantially triangular base defines an aperture arrangement therethrough; and (b) the second member further includes a surrounding wall extending generally orthogonal to the substantially triangular base.

5. A stacked arrangement according to claim 1 wherein the second member defines an aperture arrangement therethrough.

6. A stacked arrangement according to claim 1 wherein the second member further includes a surrounding wall extending generally orthogonal to the substantially triangular base.

7. A stacked arrangement according to claim 1 further comprising a food product oriented on the cooking surface.

* * * * *